US009272754B1

(12) United States Patent
Craig

(10) Patent No.: US 9,272,754 B1
(45) Date of Patent: Mar. 1, 2016

(54) MODULAR BOAT LIFT COVER

(71) Applicant: Eric N. Craig, Fort Meyers, FL (US)

(72) Inventor: Eric N. Craig, Fort Meyers, FL (US)

( * ) Notice: Subject to any disclaimer, the term of this patent is extended or adjusted under 35 U.S.C. 154(b) by 0 days.

(21) Appl. No.: 14/636,409

(22) Filed: Mar. 3, 2015

Related U.S. Application Data

(60) Provisional application No. 62/077,522, filed on Nov. 10, 2014.

(51) Int. Cl.

| | |
|---|---|
| ***B63B 17/02*** | (2006.01) |
| ***E04H 15/18*** | (2006.01) |
| ***E04H 15/32*** | (2006.01) |
| ***E04H 15/00*** | (2006.01) |

(52) U.S. Cl.
CPC ..... *B63B 17/02* (2013.01); *E04H 15/00* (2013.01); *E04H 15/18* (2013.01); *E04H 15/32* (2013.01)

(58) Field of Classification Search
CPC ..... E04H 15/16; E04H 15/18; E04H 15/008; E04H 15/32; E04H 15/60; B63B 17/02; B63B 2737/00
USPC ..... 135/114, 157–159, 153, 154, 94, 160, 135/97, 906, 908, 155; 114/263, 361; 206/321; 52/66, 79.5
See application file for complete search history.

(56) References Cited

U.S. PATENT DOCUMENTS

| | | | | | |
|---|---|---|---|---|---|
| 988,400 | A * | 4/1911 | Stonebridge | E04H 15/26 | 135/118 |
| 2,711,180 | A * | 6/1955 | Sims et al. | 135/160 | |
| 3,195,723 | A * | 7/1965 | MacDonnell | B65D 61/00 | 206/321 |
| 3,424,178 | A * | 1/1969 | Yazaki | 135/157 | |
| 4,091,584 | A * | 5/1978 | Brown | A01G 9/16 | 135/127 |
| 4,662,132 | A * | 5/1987 | Tennant | A45F 3/22 | 248/159 |
| 4,683,901 | A * | 8/1987 | Mitchell | 135/97 | |
| 5,135,018 | A * | 8/1992 | Anderson | E04H 15/26 | 135/114 |
| 5,185,972 | A * | 2/1993 | Markiewicz | 52/63 | |
| 5,419,273 | A * | 5/1995 | Cutler | 114/263 | |
| 5,526,614 | A * | 6/1996 | Huang | 52/13 | |
| 5,573,026 | A * | 11/1996 | Griffith | 135/122 | |
| 5,579,797 | A | 12/1996 | Rogers | | |
| 5,730,281 | A | 3/1998 | Powell et al. | | |
| 5,775,353 | A * | 7/1998 | Johnson | 135/96 | |
| 6,141,902 | A * | 11/2000 | Boice | A01G 9/16 | 206/223 |
| 6,367,495 | B1 * | 4/2002 | Powell et al. | 135/122 | |
| 6,397,774 | B1 * | 6/2002 | Pranger | B63B 35/44 | 114/263 |
| 7,296,584 | B2 * | 11/2007 | Goldwitz | 135/121 | |
| 7,950,342 | B2 | 5/2011 | Russikoff | | |
| 8,082,700 | B2 * | 12/2011 | Kennedy et al. | 52/86 | |
| 2004/0217030 | A1 * | 11/2004 | Tseng | 206/373 | |
| 2005/0016438 | A1 * | 1/2005 | Hey et al. | 114/361 | |
| 2005/0089375 | A1 * | 4/2005 | Fox | 405/219 | |
| 2005/0194031 | A1 | 9/2005 | Goldwitz | | |
| 2005/0252542 | A1 * | 11/2005 | Basta | 135/156 | |

(Continued)

*Primary Examiner* — Noah Chandler Hawk
(74) *Attorney, Agent, or Firm* — Gerald R. Black, Esq.

(57) ABSTRACT

The modular boat lift cover for a watercraft has a gable assembly. All of the straight components of the gable assembly are packaged into the main box frame channel for simplicity in packaging as well as quality control, ensuring no components are missing during packaging and shipping. The modular boat lift cover has a robust, lightweight design that is compatible and adjustable for width, height and length as the boat owner modifies his existing boat or purchases a new boat of different dimensions that will protect the watercraft from the elements and is designed to withstand even the severest of storms, undamaged. The modular boat lift cover is easy for the user to assemble and adjust on square lake style boat lifts, as well as the typically non-square tidal lifts.

9 Claims, 14 Drawing Sheets

(56) References Cited

U.S. PATENT DOCUMENTS

2007/0295379 A1 12/2007 Basta
2013/0239872 A1 9/2013 Perosino et al.
2014/0026804 A1* 1/2014 Templeton ..... 114/361

* cited by examiner

MODULAR BOAT LIFT COVER

CROSS REFERENCE TO RELATED APPLICATIONS

This Application is related to and claims priority to U.S. Provisional Application No. 62/077,522, entitled "Modular Boat Lift Cover", by Eric N. Nelson filed on Nov. 10, 2014.

FIELD OF USE

The present invention relates to a modular boat lift cover system which is designed for ease of shipping and assembly as well as adjustability as the lift owner changes or modifies their boat. The modular boat lift cover being unique in that it can accommodate all boat lifts that are square, such as lake lifts, as well as tidal lifts which, due to their nature of construction, are seldom square.

BACKGROUND OF THE INVENTION

A watercraft represents a significant investment. Watercraft owners store their boats on lifts understand that a boat lift cover or canopy is needed to minimize the maintenance work required to maintain the appearance of the boat. Watercraft owners need to shelter docked boats from the elements to preserve the life of the boat. While boat houses can provide such shelter, they are expensive, often impractical and, under some circumstances, not allowed by code. Watercraft owners also need to lift their watercraft out of the water for storage and maintenance, and to lower their watercraft into the water for launching or flotation at dock. There are typically two types of boat lifts: lake lifts and tidal lifts. A lake lift is typically manufactured as a complete frame system that is lowered into the water as a single unit and fastened to the lake floor. It remains square due to the calmness of inland water. Tidal lifts are typically constructed on site with a barge pounding long pilings into the sea floor onto which the boat lift mechanism is then mounted. This construction technique is subject to tidal forces during the time that the pilings are being hammered into the sea floor, which can cause the lift to be not perfectly square. Additionally, each boat lift manufacturer has its own design for the lifting I-beam, the cable system and the position of the electric motors making it difficult to design, manufacture and install a boat lift cover for tidal lifts.

Prior approaches use many different parts, while shipping in multiple boxes, or one large box. They also require complex assembly procedures and are not adjustable depending on the size of the watercraft.

U.S. Pat. No. 5,185,972 (Markiewicz) discloses an all-purpose modular canopy system including a canopy frame formed of a plurality of interconnected sections, the sections being formed of welded tubular elements. The sections are modular in configuration including end and central portions whereby the sections may be selectively assembled to produce the desired length. The canopy frame includes transversely disposed brace elements associated with supporting columns and adjustable fittings to facilitate alignment of the columns and canopy frame, and the canopy frame is covered by a flexible covering using a lacing system between the frame and covering to maintain covering tension. The covering may include a skirt cooperating with skirt stabilizers formed in the canopy frame corners for maintaining the skirt properly oriented.

U.S. Publication No. 20050252542 (Basta) discloses a boat lift canopy comprises a truss type framework with a base frame. Joined to the base frame and circumscribed by it is a tie tube frame, which may be discontinuous. A fabric cover, which in preferred embodiments is decorative as well as functional, snugly encloses the outside of the framework, wraps around the base frame and is secured to the tie tube frame.

U.S. Pat. No. 5,573,026 (Griffith) discloses a pre-fabricated boat lift canopy constructed of galvanized steel or aluminum tubing. All joints are crimped to a tight, permanent fit by using a special rolling tool. The canopy frame is mounted on "I" beams of existing boat lifts, docks, or pilings. The canopy frame is then covered with a water tight and sunlight resistant decorative canopy. Wind spoilers, in the form of canvas strips, are fastened to the peak of the canopy, a continuous strip, horizontally across the top, a strip at each end, and a third strip at the center.

U.S. Pat. No. 5,730,281 (Powell, et al.) discloses a canopy kit comprising a plurality of elongated pipes and a series of corner connectors and a package for containing the various kit components. An elongated container is provided and the various components of the kit, including the corner connectors and pipes, are disposed within the container such that the components of the kit structurally reinforce the total package and wherein the individual corner connectors are strategically disposed throughout the package so as to support the elongated pipes.

The packaging of boat lift covers and canopies currently being marketed is overly-complicated and costly, and assembly is difficult to explain even with instructions. In order to communicate the intricacies of assembly and disassembly, personal demonstrations are often required. In some cases, multiple training sessions are needed. If the complicated unpacking was not difficult enough, the procedure for layout and assembly of the frame is oftentimes even more complex. In addition to the difficulty of assembly, current boat lift covers cannot be easily adjusted if the lift owner modifies his boat, such as by adding a tower, or replaces his boat with, for example, a larger boat. Current boat lift cover designs have some degree of adjustability but are not adjustable enough to easily accommodate all boat lift mechanisms and the dimensional tolerance variations of tidal lifts.

There is a need for a modular boat lift cover system that is easier to manufacture, package, assemble and disassemble. There is a need for a modular boat lift cover system that has a robust, lightweight design that is compatible and adjustable for width, height and length as the boat owner modifies his existing boat or purchases a new boat of different dimensions, and that will protect the watercraft from the elements and is designed to withstand even the severest of storms, undamaged. There is also a need for an adjustable boat lift cover that will work with any manufacturer's boat lift and will accommodate the variation in build tolerances of tidal lifts.

It is an object of the present invention to provide a compact, all-weather, temporary shelter designed for both personnel and equipment. It is another object of the present invention to provide a modular boat lift cover that is easy to pack and assemble. All of the straight components are packaged into the main box frame channel for simplicity in packaging as well as quality control, ensuring no components are missing during packaging and shipping. It is yet another object of the present invention to provide a modular boat lift cover that is easy for the user to assemble and adjust, is intuitive and requires little training to adjust the canopy to different widths, lengths and heights both upon initial installation as well as during the life of the lift cover, enabling for the lift owner to accommodate modifications to his existing boat as well as to accommodate new boats of different dimensions. And, it is still yet another object of the present invention to provide a modular boat lift cover that is easy for the user to assemble and adjust, being compatible with square lake style boat lifts, as well as the typically non-square tidal lifts.

SUMMARY OF THE INVENTION

The modular boat lift cover of the present invention addresses these needs.

The modular boat lift cover of the present invention comprises a gable assembly of straight tubes, a canopy, and an adjustable support structure to accommodate the height of various watercraft.

The gable assembly includes a plurality of peak fittings, a plurality of box frame support members, a plurality of pipe fittings disposed on the box frame support members, and a plurality of tubes securely attaching the peak fittings to the box frame support members enabling for either a straight or curved roof design as well as no overhang or various lengths of overhang, depending on the customer's preference.

The plurality of peak fittings are positioned between the box frames and a peak fitting connector tube of the gable assembly, the peak fitting connector tube being connected by at least one end peak fitting.

The plurality of box frame support members are preferably two parallel members, although other configurations are also envisioned. Preferably, the plurality of box support members is essentially parallel to the peak fitting connector tube. The peak fittings, the peak fitting connector tube, and additional connectors and fasteners can be stored inside the plurality of box frame support members during shipping.

The plurality of tubes are used as needed to attach the peak fittings to the box frame and to lay a foundation for the canopy. The plurality of tubes securely attach the peak fitting connectors to the box frame support members by engaging with the plurality of pipe fittings.

The canopy covers the gable assembly protecting the watercraft from the sun, rain and storms, the canopy being securely affixed to the gable assembly.

An adjustable support structure enables elevation and lowering of portions of the gable assembly of the modular boat lift cover of the present invention. The support structure is compatible with a wide variety of modular boat lift covers.

The gable assembly is supported upon the adjustable support structure which includes a plurality of beam brackets and a plurality of support columns, each support column being disposed within a beam bracket. The adjustable support structure provides a vertical adjustment for portions or all of the gable assembly.

All of the length, width and height assemble points are designed to have a wide range of adjustment. This wide range of adjustment is what enables the modular boat lift cover of the present invention to accommodate boat lifts from any manufacturer as well as accommodating square lake lifts and out-of-square tidal lifts. In addition, the range of adjustment enables for easy configuration for different sizes of watercraft.

The modular boat lift cover of the present invention combines the advantages is a portable structure which in its collapsed state forms a standard shipping container for ease of transport.

The box frames of the modular boat lift cover of the present invention serves as shipping containers and modular building blocks for expanding the modular boat lift cover to adapt to a completely different watercraft purchased by the owner.

For a complete understanding of the modular boat lift cover of the present invention, reference is made to the accompanying drawings and description in which the presently preferred embodiments of the invention are shown by way of example. As the invention may be embodied in many forms without departing from spirit of essential characteristics thereof, it is expressly understood that the drawings are for purposes of illustration and description only, and are not intended as a definition of the limits of the invention.

DETAILED DESCRIPTION OF THE PREFERRED EMBODIMENTS

Figure 1:
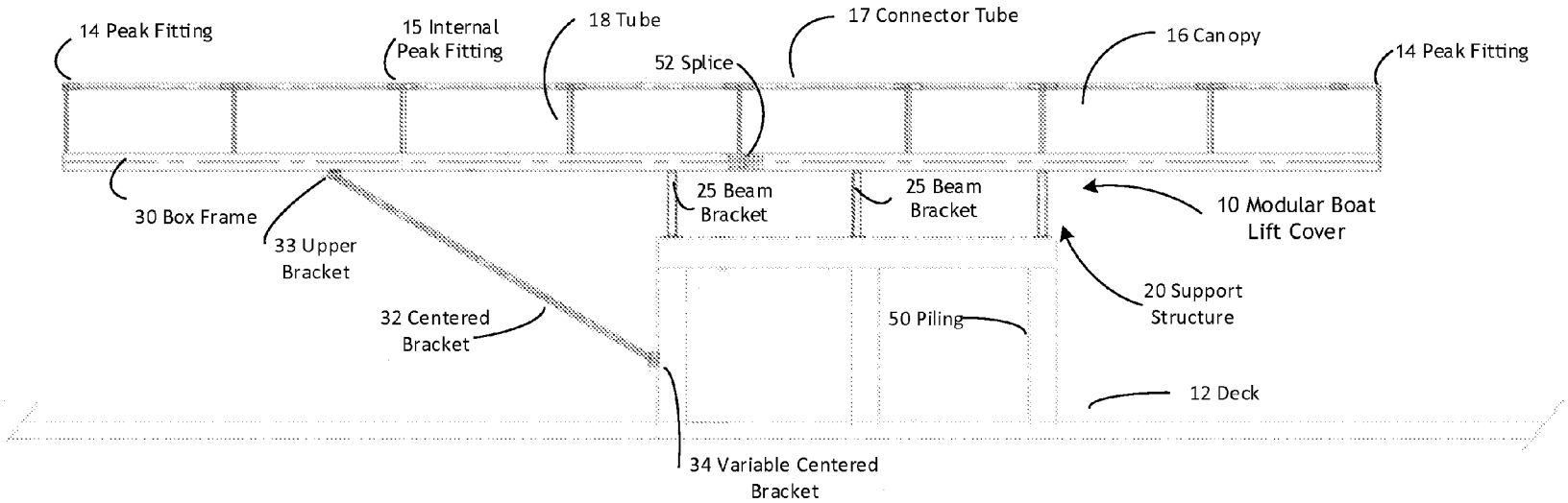
FIG. 1 depicts a first preferred embodiment of an assembly side view of the modular boat lift cover of the present invention.

Referring now to the drawings, FIG. 1 depicts a preferred embodiment of an assembly side view of the modular boat lift cover of the present invention [10].

The modular boat lift cover of the present invention [10] comprises a gable assembly [13], a canopy [16], and an adjustable support structure [20] for a watercraft.

The gable assembly [13] includes a plurality of end peak fittings [14] and internal peak fittings [15], as further depicted in FIGS. 5A, 5B, 5C, 5D, a plurality of box frame support members [30], and a plurality of tubes [18] securely attaching the end peak fittings [14] and the internal peak fittings [15] to the box frame support members [30].

The plurality of peak fittings [14 and 15] are positioned on the gable assembly, the peak fittings being connected by at least one peak fitting connector tube [17].

The plurality of box frame support members [30] are preferably two parallel members, although other configurations are also envisioned. Preferably, the box frame support members [30] are essentially parallel to the peak fitting connector tube [17]. The peak fittings [14 and 15], the peak fitting connector tube [17], tubes [18], and additional connectors and fasteners (not shown) can be stored inside the plurality of box frame support members [30] prior to assembly and during shipping.

Tubes [18] are used as needed to attach the peak fitting connector tube [17] to the box frame support members [30] and to lay a foundation for the canopy [16]. The tubes [18] securely attach the peak fittings [14 and 15] and the peak fitting connector tube [17] to the box frame support members [30].

The canopy [16] covers the gable assembly [13] protecting the watercraft from the sun and rain. The canopy [16] is securely affixed to the gable assembly [13]. The canopy [16] can be of any fabric type material which has sufficient wind- and ultraviolet- (UV) resistant properties, with the preferred embodiment being vinyl for its durability and ease of maintenance.

The adjustable support structure [20] enables elevation and lowering of portions of the gable assembly [13] of the modular boat lift cover of the present invention [10]. The adjustable support structure [20] is compatible with a wide variety of modular boat lift covers, and can be mounted on any type of boat lift.

Figure 9A:
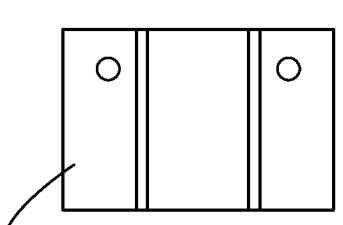
FIG. 9A depicts a preferred embodiment of the end view of the upper bracket for the centered bracket of FIG. 1.
Figure 9B:
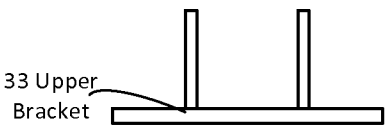
FIG. 9B depicts a preferred embodiment of the side view of the upper bracket for the centered bracket of FIG. 1.
Figure 9C:
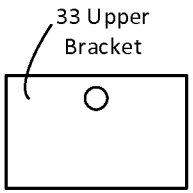
FIG. 9C depicts a preferred embodiment of the front view of the upper bracket for the centered bracket of FIG. 1.
Figure 10A:
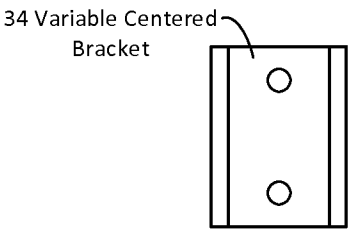
FIG. 10A depicts a preferred embodiment of the end view of the variable centered bracket for the centered bracket of FIG. 1.
Figure 10B:
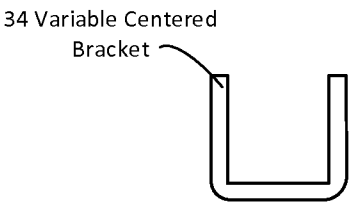
FIG. 10B depicts a preferred embodiment of the side view of the variable centered bracket for the centered bracket of FIG. 1.
Figure 10C:
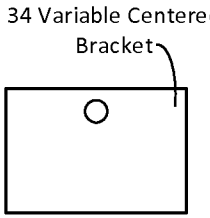
FIG. 10C depicts a preferred embodiment of the front view of the variable centered bracket for the centered bracket of FIG. 1.

For larger watercraft a longer gable assembly [13] is required, and additional ballast is needed. The modular boat lift cover [10] includes a pair of centered brackets [32], one secured to each box frame [30] with an upper bracket [33] and secured to the deck assembly [12] with a variable centered bracket [34]. The upper bracket [33] for the centered bracket [32] is depicted in FIGS. 9A, 9B and 9C. The variable centered bracket [34] for the centered bracket [32] is depicted in FIGS. 10A, 10B and 10C.

Figures 2A, 2B, 2C:
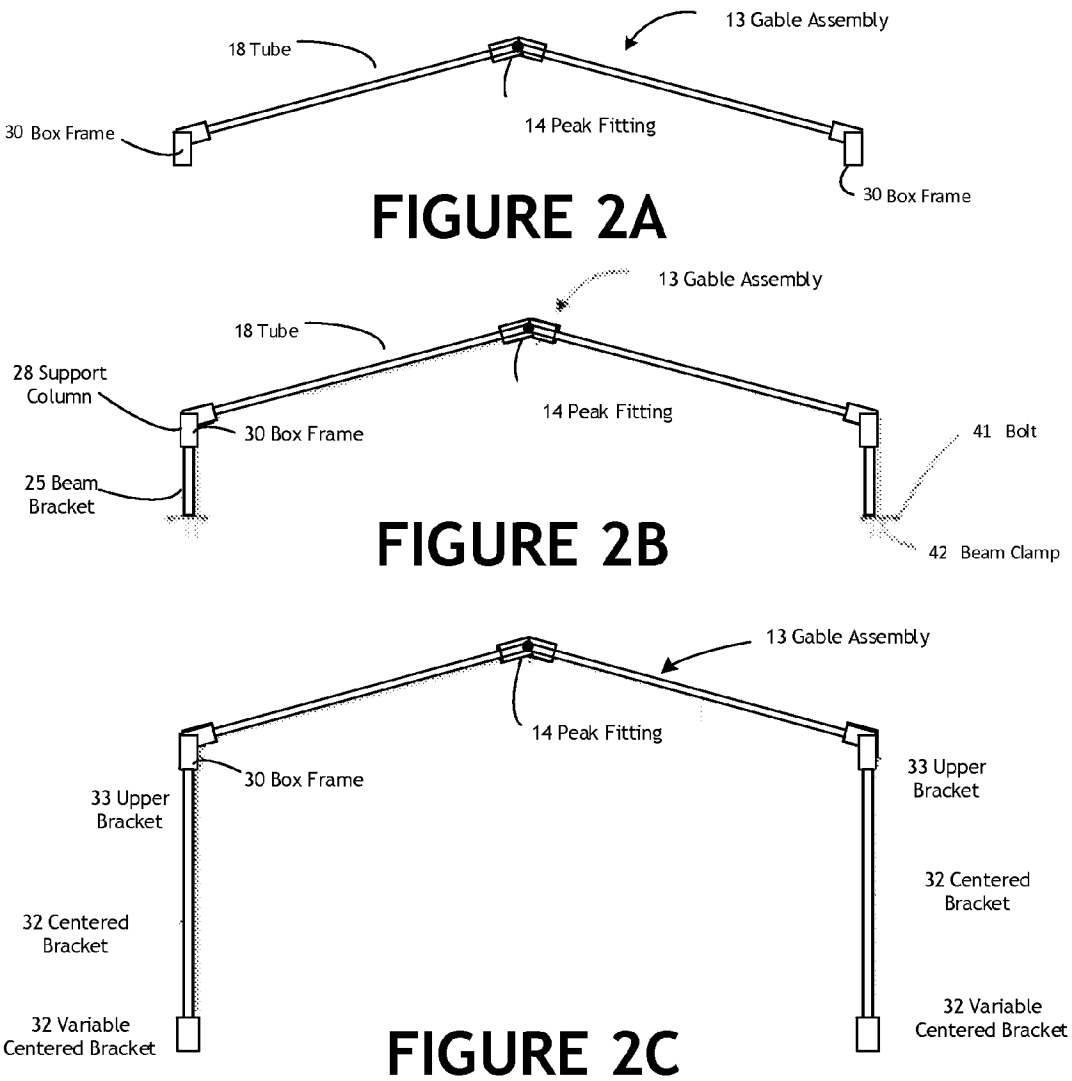
FIG. 2A depicts an assembly end view of the preferred embodiment of a gable assembly for the modular boat lift cover of the present invention of FIG. 1.
FIG. 2B depicts a preferred embodiment of an end view of the gable assembly of FIG. 1 mounted on a pair of support columns and beam brackets.
FIG. 2C depicts a preferred embodiment of an end view of the gable assembly of FIG. 1 mounted on a pair of upper brackets, centered brackets and variable centered brackets.

FIG. 2A depicts an assembly end view of a preferred embodiment of a gable assembly [13] for the modular boat lift cover of the present invention [10]. FIG. 2B depicts a preferred embodiment of an end view of the gable assembly [13] of FIG. 2A mounted on an adjustable support structure [20]. The gable assembly [13] is supported upon the adjustable support structure [20] which includes a plurality of beam brackets [25] and a plurality of support columns [28], each support column [28] being disposed within a beam bracket [25]. The adjustable support structure [20] provides a vertical adjustment for portions or all of the gable assembly [13]. The adjustable support structure [20] enables the bow section of the gable assembly [13] to be raised or lowered, the stern section of the gable assembly [13] to be raised or lowered, or their combination to be raised or lowered. Similarly, the port and starboard sections of the gable assembly [13] can be raised or lowered. The preferred angle between the tubes [18] of the gable assembly [13] is 150°.

FIG. 2C depicts a preferred embodiment of an end view of the gable assembly [13] of FIG. 2A mounted on a pair of centered brackets [32] and variable centered brackets [34].

The centered brackets [32] are secured to the box frame support members [30] by a pair of upper brackets [33].

Figure 2D:
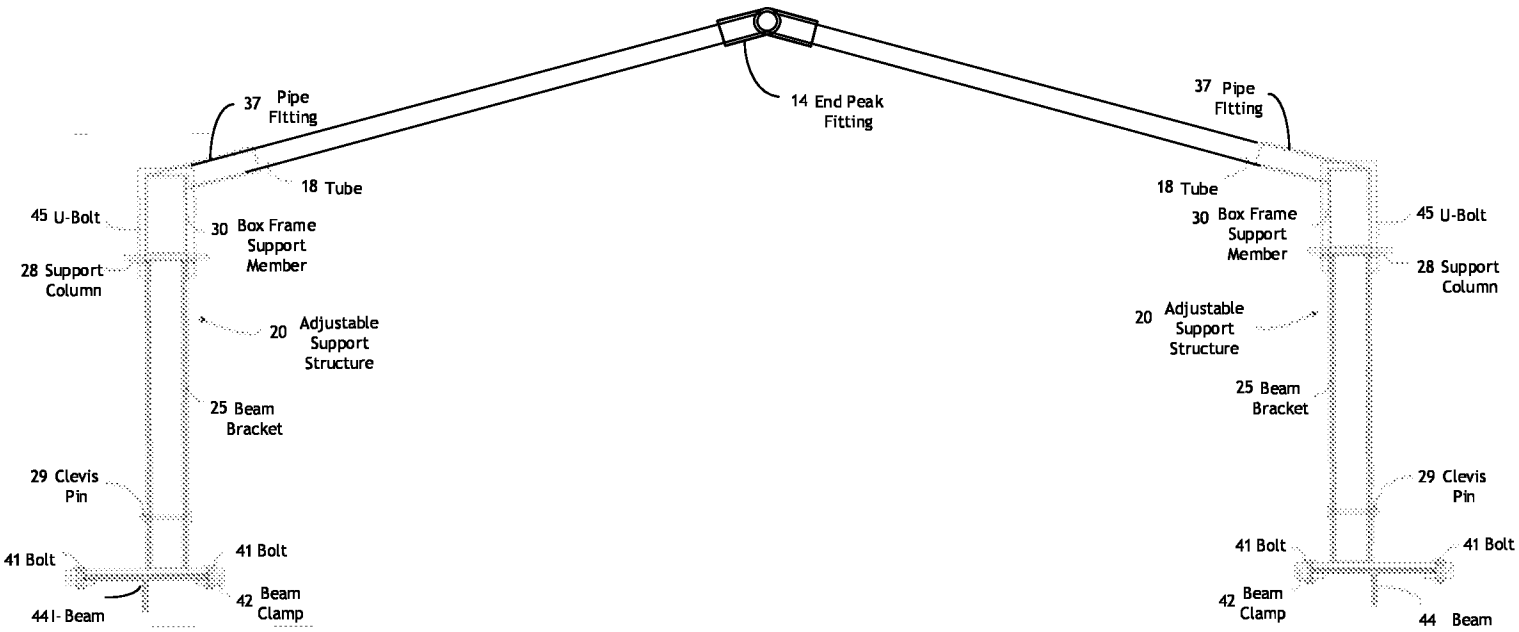
FIG. 2D depicts an exploded view of a preferred embodiment of an end view of the gable assembly of FIG. 1 attached to a pair of support columns with U-bolts, and a pair of beam brackets secured to I-beams with beam clamps.

FIG. 2D depicts an exploded view of a preferred embodiment of an end view of the gable assembly [13] and adjustable support structure [20] of FIG. 2B. Tubes [18] are inserted into the end peak fitting [14] and pipe fittings [37], which are in turn attached to the box frame support members [30]. The box frame support members [30] are fastened to the support columns [28] with U-bolts [45]. Each support column [28] is disposed within a beam bracket [25] and held in place with a clevis pin [29]. The clevis pin [29] can be removed to enable vertical adjustment of the support column [28] within the beam bracket [25]. The beam brackets [25] are in turn fastened to I-beams [44] of the deck assembly [12] using bolts [41] and beam clamps [42].

Figure 3:
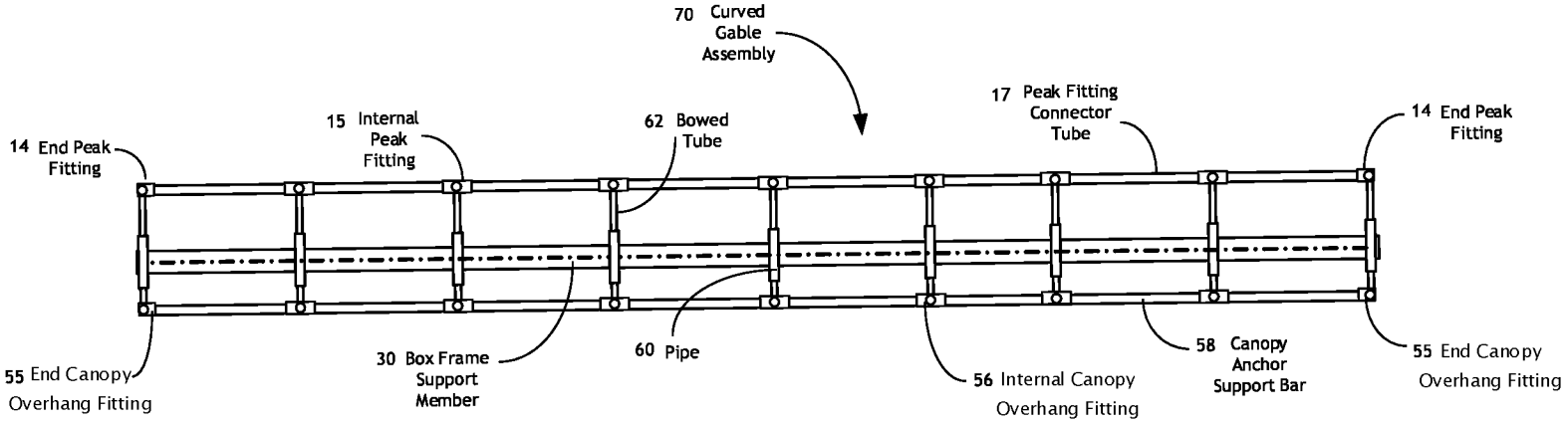
FIG. 3 depicts an assembly side view of a second preferred embodiment the modular boat lift cover of the present invention, the tube members being curved.

FIG. 3 depicts a preferred embodiment of an assembly side view of a curved gable assembly [70] of the modular boat lift cover of the present invention [10].

The curved gable assembly [70] includes a plurality of end peak fittings [14] and internal peak fittings [15], as further depicted in FIGS. 5A, 5B, 5C, 5D, a plurality of box frame support members [30], and a plurality of bowed tubes [62] that are initially linear in shape but become bowed under stress are securely attaching the end peak fittings [14] and the internal peak fittings [15] to the box frame support members [30].

The plurality of peak fittings [14 and 15] are positioned on the curved gable assembly [70], the peak fittings being connected by at least one peak fitting connector tube [17].

The plurality of box frame support members [30] are preferably two parallel members, although other configurations are also envisioned. Preferably, the box frame support members [30] are essentially parallel to the peak fitting connector tube [17]. The peak fittings [14 and 15], the peak fitting connector tube [17], bowed tubes [62], and additional connectors and fasteners (not shown) can be stored inside the plurality of box frame support members [30] during shipping.

The bowed tubes [62] are used as needed to attach the peak fitting connector tube [17] to the box frame support members [30] and to lay a foundation for the canopy [16]. The bowed tubes [62] securely attach the peak fittings [14 and 15] and the peak fitting connector tube [17] to the box frame support members [30] using pipes [60] attached to the box frame support members [30].

An advantage of the curved gable assembly [70] is that it enables the creation of a canopy overhang on either side of the modular boat lift cover of the present invention [10]. This enables additional protection of the watercraft from sun and rain and provides additional support during storms and high winds.

Figure 5A:
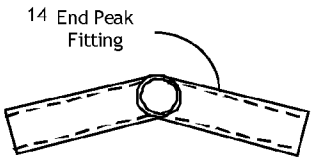
FIG. 5A depicts a preferred embodiment of the front view of the end peak fitting for the modular boat lift cover of FIGS. 1 and 3.
Figure 5B:
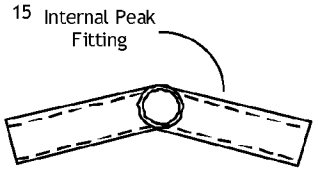
FIG. 5B depicts a preferred embodiment of the front view of the internal peak fitting for the modular boat lift cover of FIGS. 1 and 3.
Figure 5C:
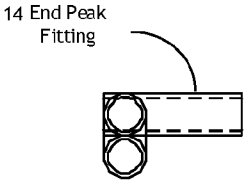
FIG. 5C depicts a preferred embodiment of the side view of the end peak fitting of FIG. 5A.
Figure 5D:
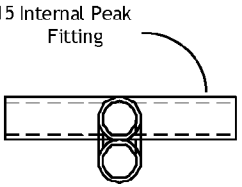
FIG. 5D depicts a preferred embodiment of the side view of the internal peak fitting of FIG. 5B.
Figure 5E:
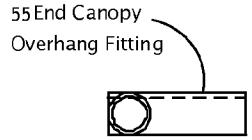
FIG. 5E depicts a preferred embodiment of the top view of the end overhang fitting for the modular boat lift cover of FIG. 3.
Figure 5F:
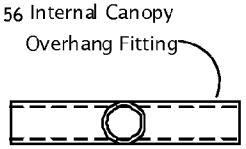
FIG. 5F depicts a preferred embodiment of the top view of the internal overhang fitting for the modular boat lift cover of FIG. 3.

The canopy overhang comprises a canopy anchor support bar [58] which is preferably parallel to the box frame support members [30] and the peak fitting connector tube [17]. The canopy anchor support bar is connected to the box frame support member [30] using a plurality of end canopy overhang fittings [55] and internal canopy overhang fittings [56], which are further depicted in FIGS. 5E and 5F.

The canopy overhang can be adjusted to suit the user's needs. For example, if the modular boat lift cover of the present invention [10] is installed in an east-west orientation, there will be more exposure to the sun throughout the day on the southern side of the watercraft. The canopy overhang can be installed such that the side facing south is longer, thus providing more protection from the sun.

Figure 4A:
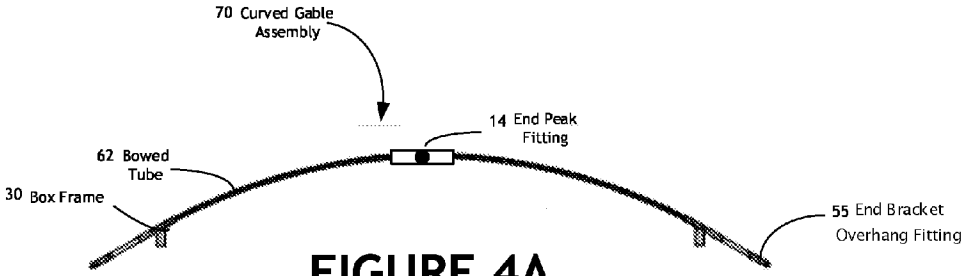
FIG. 4A depicts an assembly end view of a gable assembly for the modular boat lift cover of FIG. 3.
Figure 4B:
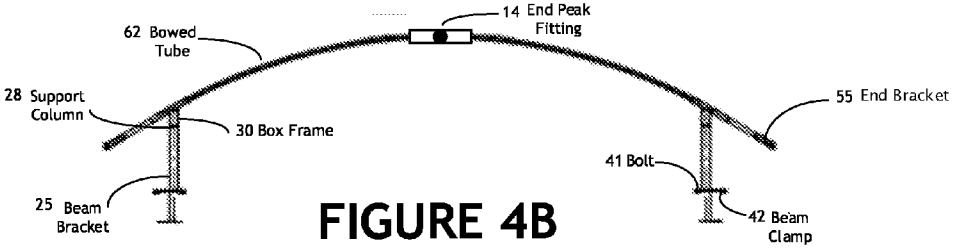
FIG. 4B depicts a preferred embodiment of an end view of the curved gable assembly of FIG. 4A mounted on a pair of support columns and beam brackets.
Figure 4C:
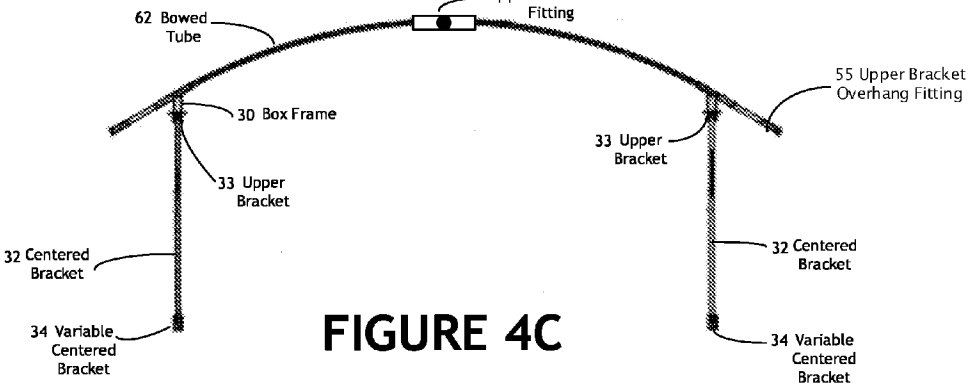
FIG. 4C depicts a preferred embodiment of an end view of the curved gable assembly of FIG. 4A mounted on a pair of upper brackets, centered brackets and variable centered brackets.

FIGS. 4A, 4B and 4C depict an assembly end view of a preferred embodiment of a curved gable assembly [70] for the modular boat lift cover of the present invention [10], similar to FIGS. 2A, 2B and 2C, with the bowed tubes [62].

Figure 4D:
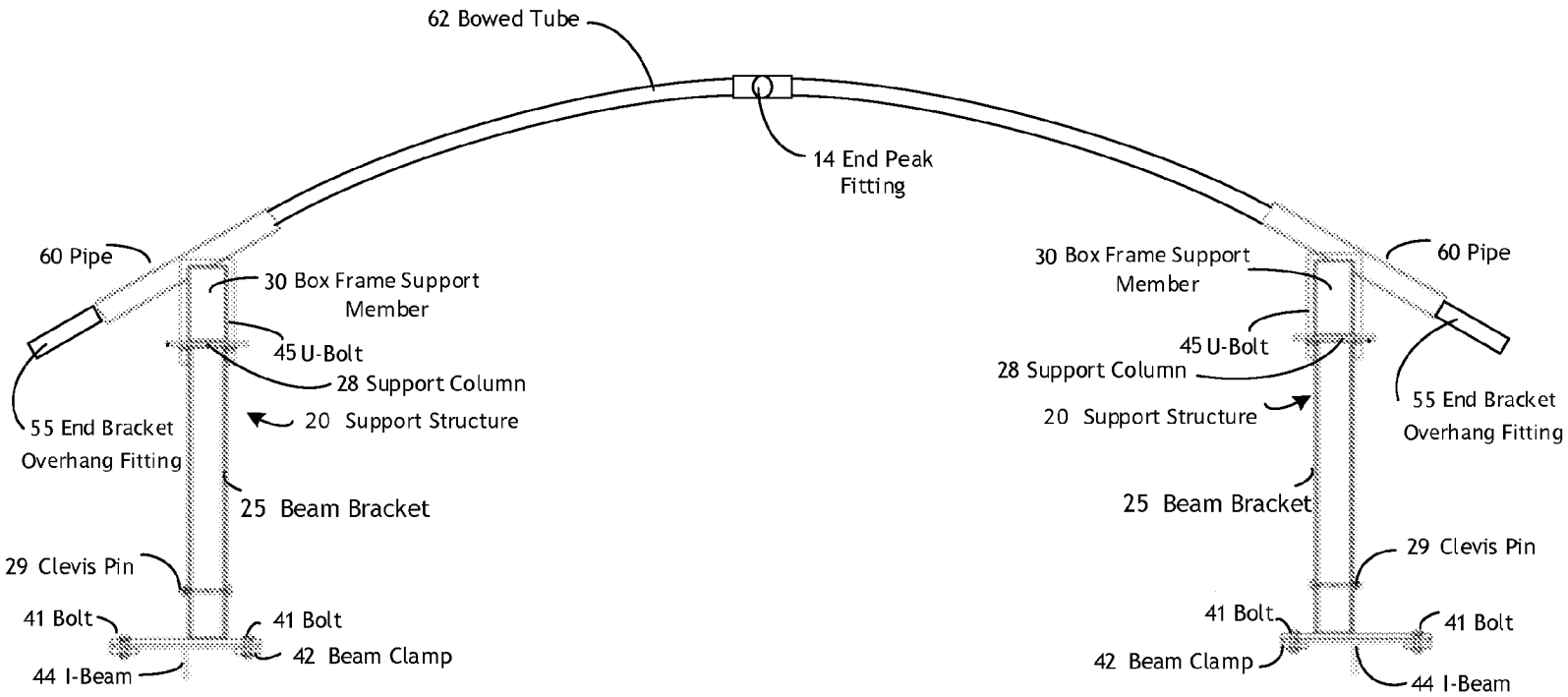
FIG. 4D depicts a preferred embodiment of an end view of the curved gable assembly of FIG. 4A attached to a pair of support columns with U-bolts, and a pair of beam brackets secured to I-beams with beam clamps.

FIG. 4D depicts an exploded view of a preferred embodiment of an end view of the curved gable assembly [70] and adjustable support structure [20] of FIG. 4B. The tubes [62] are inserted into the end peak fitting [14] and pipes [60], which are in turn attached to the box frame support members [30]. The box frame support members [30] are fastened to the support columns [28] with U-bolts [45]. Each support column [28] is disposed within a beam bracket [25] and held in place with a clevis pin [29]. The clevis pin [29] can be removed to enable vertical adjustment of the support column [28] within the beam bracket [25]. The beam brackets [25] are in turn fastened to I-beams [44] of the deck assembly [12] using bolts [41] and beam clamps [42].

Figure 6A:
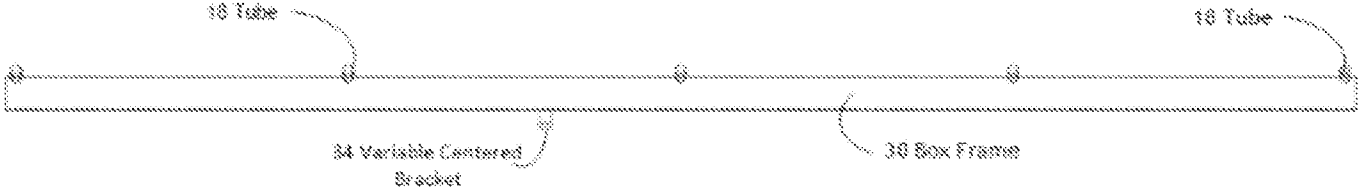
FIG. 6A depicts a preferred embodiment of a side view of the box frame of for the modular boat lift cover of FIG. 1.
Figure 6D:
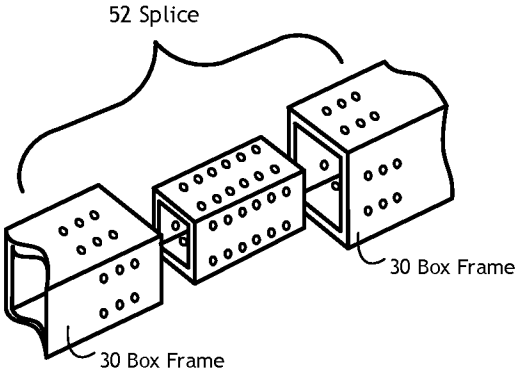
FIG. 6D depicts an isometric view of a preferred embodiment of the box frame splice assembly of the modular boat lift cover of FIG. 1.
Figure 6C:
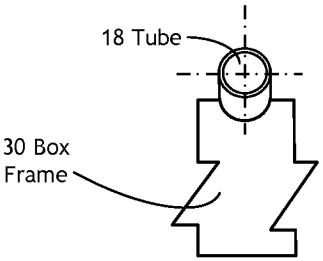
FIG. 6C depicts a preferred embodiment of a typical exploded front view of the box frame engagement with a pipe fitting of the gable assembly of the modular boat lift cover of FIGS. 2A, 2B and 2C.
Figure 6B:
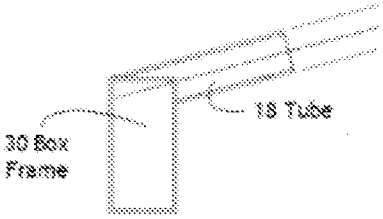
FIG. 6B depicts a preferred embodiment of a simplified end view of the box frame engagement with a pipe fitting of the gable assembly of the modular boat lift of FIGS. 2A, 2B and 2C.

FIG. 6A depicts the box frame support member [30] as well as pipe fittings [37] and the upper bracket [33]. FIG. 6B depicts an end view of the box frame support member [30] with the attached pipe fitting [37] and tube [18], which forms part of the gable assembly [13]. FIG. 6C depicts a side view of the box frame support member [30] with the attached pipe fitting [37]. FIG. 6D depicts an isometric view of two box frame support members [30] and a splice reinforcement [52], which is used for connecting the box frame support members [30] and strengthening the connection juncture. This enables the user to vary the length of the modular boat lift cover of the present invention [10]. For smaller watercraft, the box frames [30] will not need to be spliced together in the gable assemblies, but rather a single box frame [30] on each side of the gable assemble will suffice. Only for larger watercraft, will multiple modular gable assemblies be needed, and the splice reinforcements [52] are needed to strengthen these junctures.

Figure 7A:
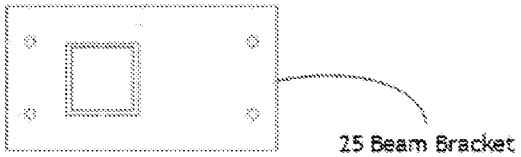
FIG. 7A depicts a preferred embodiment of a simplified top view of a beam bracket of the modular boat lift cover of FIGS. 1 and 3.
Figure 7B:
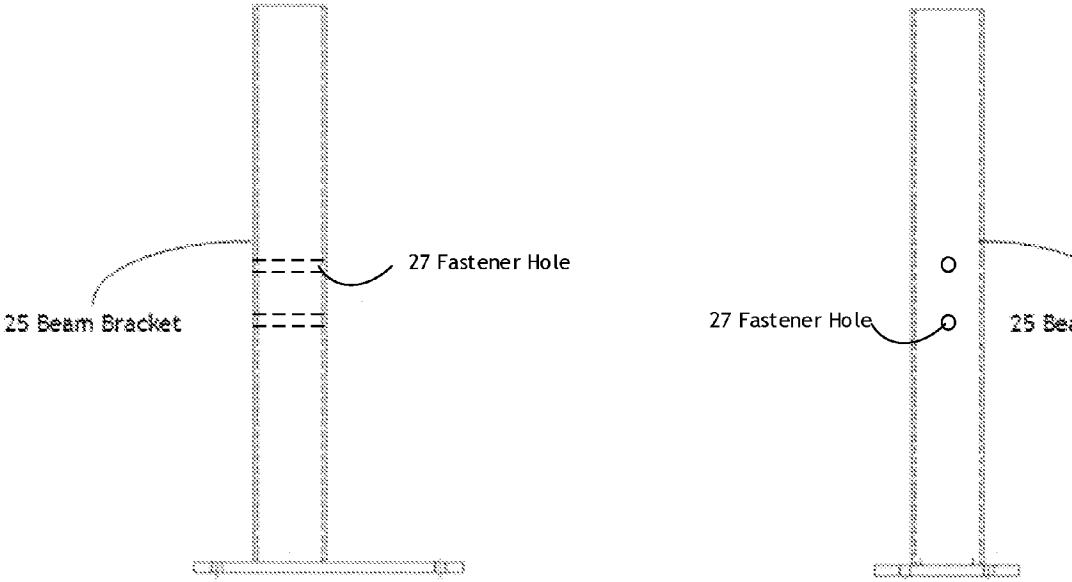
FIG. 7B depicts a preferred embodiment of a simplified side view of a beam bracket of the modular boat lift cover of FIGS. 1 and 3.
Figure 7C:
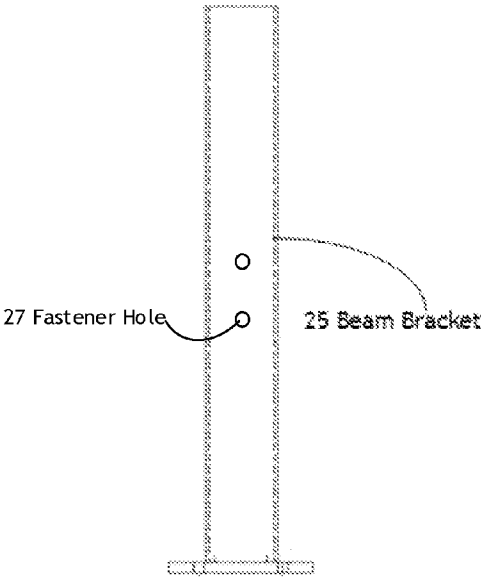
FIG. 7C depicts a preferred embodiment of a simplified front view of a beam bracket of the modular boat lift cover of FIGS. 1 and 3.

The preferred embodiment of the beam bracket [25] of the modular boat lift cover of the present invention [10] is depicted in FIGS. 7A, 7B, and 7C. Holes [27] for the insertion of a clevis pin [29] are shown. The bottom plate is adjustable as after said bottom plate is secured to the beam bracket [25] excess may be cut off after mounting. The beam bracket [25] can be rotated 180°, on one side or both sides of the lift cover to enable for boat accessories such as outriggers or just to give additional protection from sunlight and rain.

In one preferred embodiment, the modular boat lift cover of the present invention [10] features a top drive shaft used to raise and lower the boat. Box risers (not shown) may be used to provide raised attachment points for the beam brackets [25]. A box lift riser is attached to the boat lift frame on both sides of the drive shaft along the longitudinal axis. This enables normal functioning of the drive shaft with no interference from the beam brackets [25].

Figure 8A:
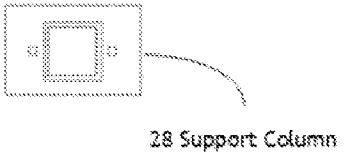
FIG. 8A depicts a preferred embodiment of a simplified top view of a support column of the modular boat lift cover of FIGS. 1 and 3.
Figure 8B:
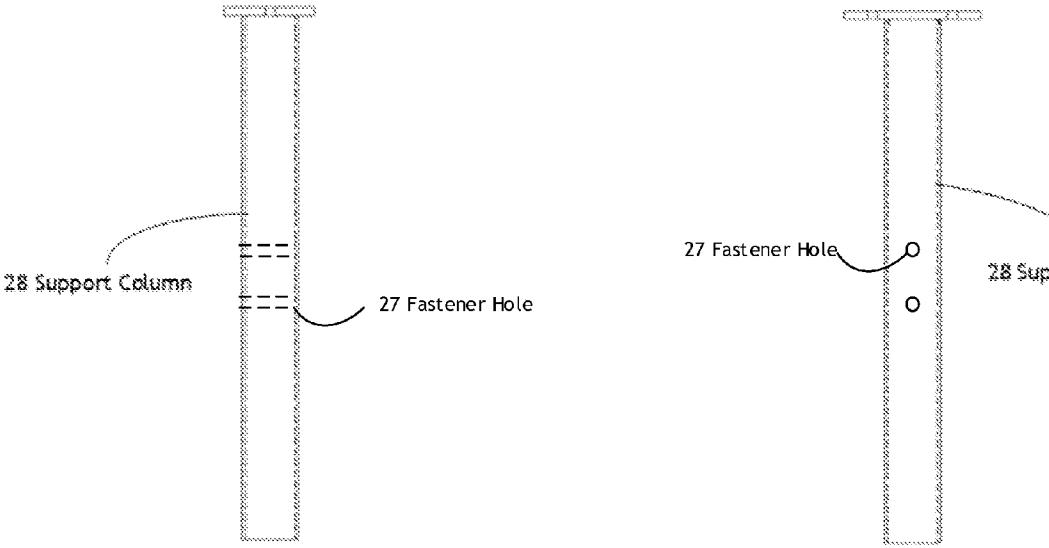
FIG. 8B depicts a preferred embodiment of a simplified side view of a support column of the modular boat lift cover of FIGS. 1 and 3.
Figure 8C:
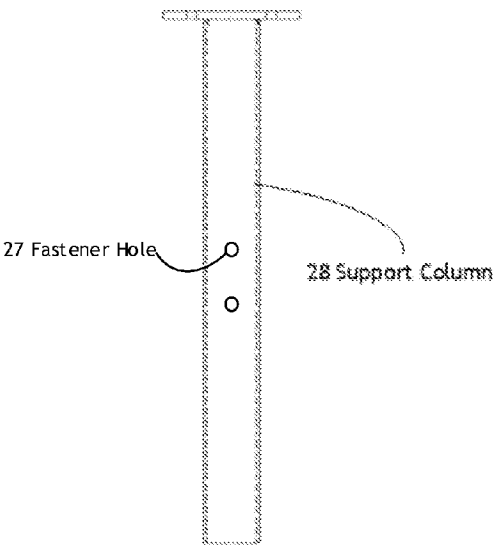
FIG. 8C depicts a preferred embodiment of a simplified front view of a support column of the modular boat lift cover of FIGS. 1 and 3.

The preferred embodiment of the support column [28] is depicted in FIGS. 8A, 8B, and 8C. The support column [28] is a bit smaller than the beam bracket [25] and fits inside the beam bracket [25]. A clevis pin [29] as shown in FIGS. 2D and 4D enables the relative height of the support column relative to the beam bracket [25] to be adjusted. Holes for the insertion of a clevis pin [29] are shown.

Figure 11:
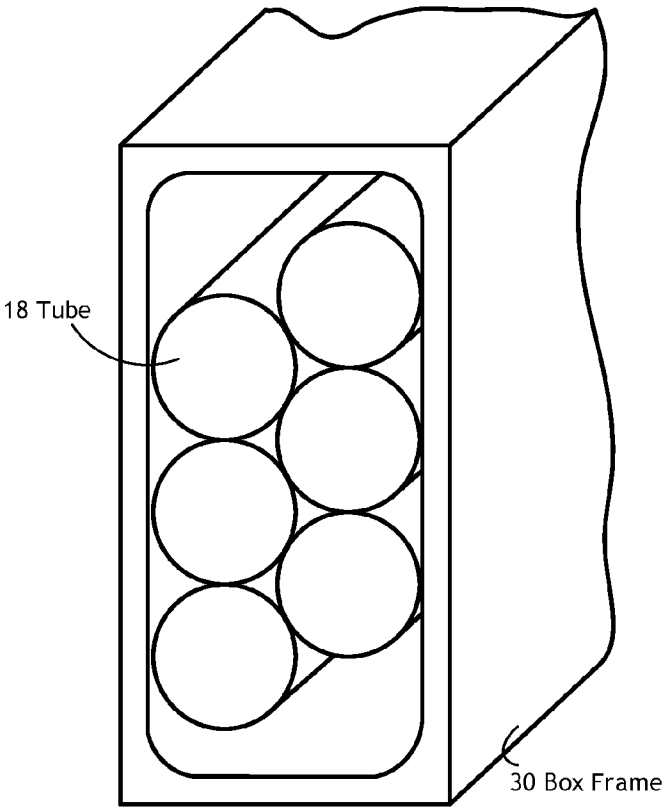
FIG. 11 depicts a plurality of tubes packaged inside a box frame of the gable assembly for the modular boat lift covers of FIGS. 1 and 3.

FIG. 11 depicts a plurality of tubes [18] packaged inside a box frame support member [30] of the gable assembly [13] for the modular boat lift cover of the present invention [10]. This packaging method enables for ease of shipping, and ensures no parts are missing.

Figure 12:
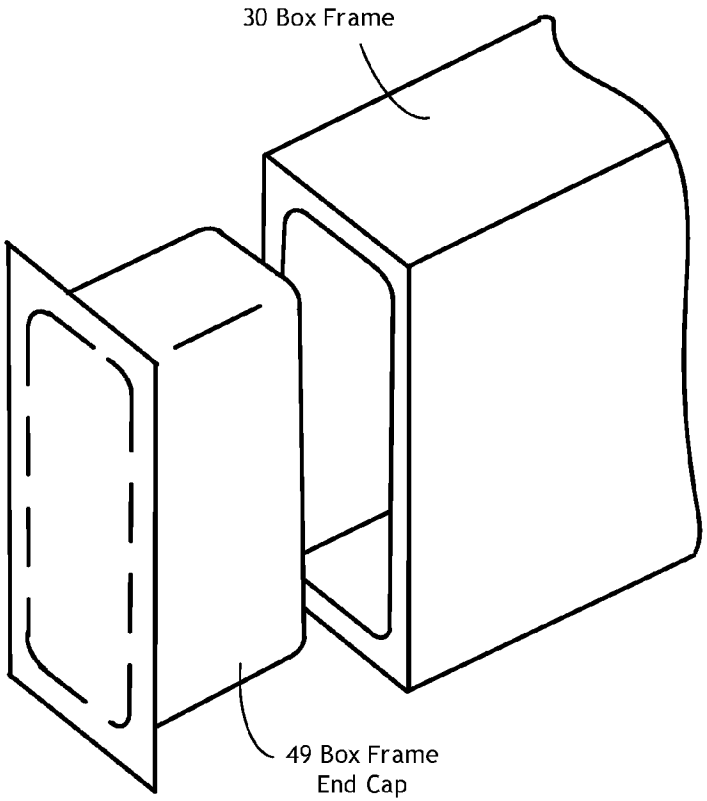
FIG. 12 depicts an isometric view of a preferred embodiment of the box frame end cap and box frame of the modular boat lift covers of FIGS. 1 and 3.

FIG. 12 depicts an isometric view of a preferred embodiment of the box frame end cap [49] and box frame support member [30] of the modular boat lift cover of the present invention [10]. The box frame end cap [49] fits securely into the box frame support member [30]. During shipping, this prevents the other components of the modular boat lift cover

[10] from falling out. Once the modular boat lift cover [10] is installed by the user, the box frame end cap [49] prevents debris and other material from entering the channel of the box frame support member [30].

Figure 13A:
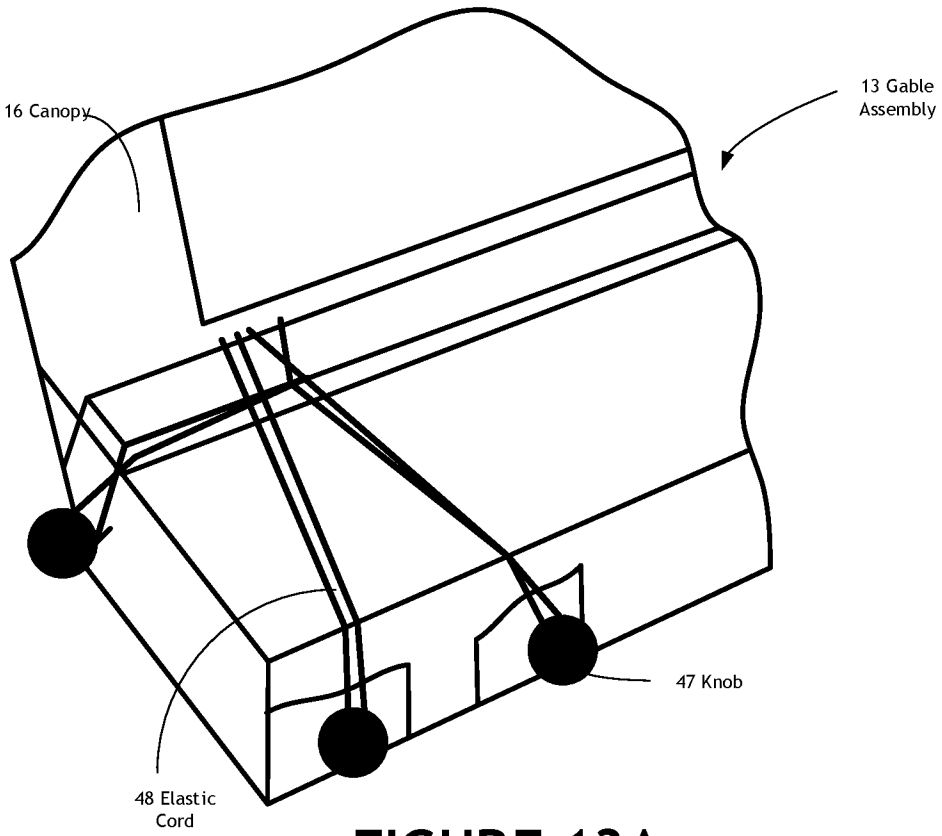
FIG. 13A depicts one preferred embodiment for attaching the canopy to the box frame of the boat lift cover of FIGS. 1 and 2A.

FIG. 13A depicts one preferred embodiment for attaching the canopy [16] to the gable assembly [13] of the modular boat lift cover of the present invention [10]. Knobs [47] and elastic cords [48] are used to secure the canopy [16] in place. In a second preferred embodiment of the modular boat lift cover of the present invention, the canopy [16] is sold separately and is not included in the assembly.

Figure 13B:
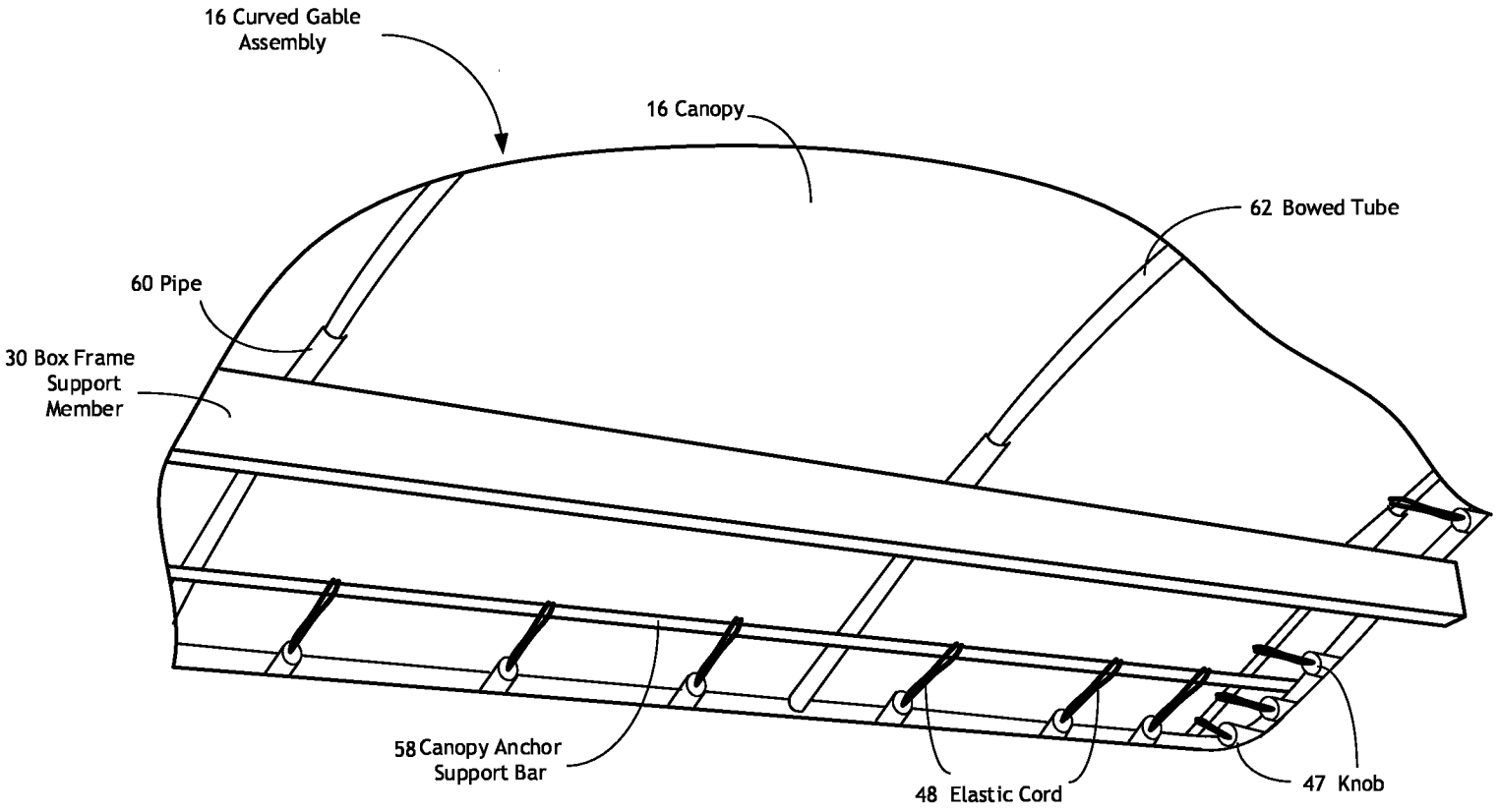
FIG. 13B depicts one preferred embodiment for attaching the canopy to the box frame of the boat lift cover of FIGS. 3 and 4A.

FIG. 13B depicts another view of a preferred embodiment for attaching the canopy [16] to the curved gable assembly [70] of the modular boat lift cover of the present invention [10]. The canopy [16] is stretched over the curved tubes [62] which are inserted into the pipes [60]. The pipes [60] are attached to the box frame support member [30]. Knobs [47] and elastic cords [48] are used to secure the canopy [16] in place. The elastic cords [48] are attached to the canopy anchor support bar [58].

The modular boat lift cover of the present invention [10] will be used on any boat lift and will replace the complicated current manufacturing process, complicated design, costly training of the sales force and installation teams, and will be stronger and last longer for the customer. This new design is a boat lift cover or canopy that is adjustable for width, height, length and placement on almost any boat lift.

The modular boat lift cover of the present invention [10], preferably includes two 3 inch×6 inch aluminum box frame support members [30] with stainless steel connection bolts covered with a unique vinyl cover. This design has many fewer parts than current designs and will establish a new standard of strength and flexible and scalable design at a much lower cost. Significant cost savings will also be achieved with the tubes [18] fitting into the 3 inch×6 inch box frame support members [30]. In addition, customers will see a significant reduction in installation and service costs. This is only possible because of the simplicity in design and packaging. Also, there is a box frame end cap [49] which is included which covers the open end of the box frame support members [30] in order to prevent birds and other animals from taking up residence in the box frame support members [30].

Some of the many novel features of the modular boat lift cover of the present invention [10] include that the modular boat lift cover [10] is compatible with and will mount or fit on almost any boat lift, it is adjustable for the width, height and length of most any watercraft. Also, the tubes [18] and multiple gable components will fit into the box frame support members [30] for high density packaging, protecting the gable assembly [13] components, insuring that the kit is complete (no parts are missing), ease of assembly and significant cost savings both in the manufacturing process as well as the installation process. The modular boat lift cover of the present invention [10] is also designed to survive wind speeds of greater than 150 miles per hour, or those found in a Category 5 hurricane. However, the vinyl cover must be and is easily removable by the modular boat lift cover [10] owner in event of a hurricane or other high winds.

Also, the modular boat lift cover [10] is designed to withstand winds of up to 180 miles per hour. The structural framing members have been designed in accordance with Florida Building Code Section 3105—Awnings and Canopies—specifically Section 3105.4.2.1 parts 1, 2 and 3, based on a rational analysis using Category 1 hurricane winds and exposure "D" corrosion. The design condition basis is a minimum wind gust velocity of 116 miles per hour (for 3 seconds) when the cover has been removed, and an ultimate sustained wind speed of 150 miles per hour. In the event of a hurricane, the owner will be able to quickly and easily remove the canopy [16].

All of the components of the gable assembly [13] will fit into the channel of one of the 3"×6" aluminum box frame support members [30], thereby improving quality control and packaging for the manufacturer, as well as giving the customer peace of mind knowing that everything will be in place without having multiple packages to deal with.

The preferred embodiment of the modular boat lift cover of the present invention [10] uses aluminum construction in all materials to make the apparatus lighter and easier to use as well as corrosion resistant. However, other lightweight materials may also be used that are corrosion resistant and provide the unit with the necessary strength.

Accordingly, it will thus be seen from the foregoing description that the modular boat lift cover of the present invention [10] along with the accompanying drawings provides a new and useful modular gable assembly that is expandable and readily modifiable to adapt to changes in the watercraft. In addition, the modular boat lift cover of the present invention [10] can be deployed with a different watercraft having desired advantages and characteristics, enabling the owner of the watercraft to deploy the modular boat lift cover of the present invention [10] as a building block to accommodate other watercraft that he or she may subsequently acquire.

Throughout this application, various Patents and Applications are referenced by number and inventor. The disclosures of these documents in their entireties are hereby incorporated by reference into this specification in order to more fully describe the state of the art to which this invention pertains.

It is evident that many alternatives, modifications, and variations of the adjustable modular boat lift cover of the present invention will be apparent to those skilled in the art in light of the disclosure herein. For example, the system can be used for all types of boat lifts as well as other applications, such as a portable event tent. It is intended that the metes and bounds of the present invention be determined by the appended claims rather than by the language of the above specification, and that all such alternatives, modifications, and variations which form a conjointly cooperative equivalent are intended to be included within the spirit and scope of these claims.

PARTS LIST

10. Modular Boat Lift Cover
12. Deck Assembly
13. Gable Assembly
14. End Peak Fitting
15. Internal Peak Fitting
16. Canopy
17. Peak Fitting Connector Tube
18. Tube
20. Adjustable Support Structure
25. Beam Bracket
27. Fastener Hole
28. Support Column
29. Clevis Pin
30. Box Frame Support Member
32. Centered Bracket
33. Upper Bracket
34. Variable Centered Bracket
37. Pipe Fitting
41. Bolt

42. Beam Clamp
44. I-Beam
45. U-Bolt
47. Knob
48. Elastic Cords
49. Box Frame End Cap
50. Piling
52. Splice
55. End Canopy Overhang Fitting
56. Internal Canopy Overhang Fitting
58. Canopy Anchor Support Bar
60. Pipe
62. Bowed Tube
70. Curved Gable Assembly

I claim:

1. A modular boat lift cover for a first watercraft, said modular boat lift cover comprising:

a gable assembly including;

a plurality of peak fittings positioned on a peak of said gable assembly;

a plurality of support tubes securely supporting said plurality of peak fittings, said plurality of support tubes securely engaging at least one of said plurality of peak fittings;

a first and a second box frame support member each supporting at least one of said plurality of support tubes, said plurality of peak fittings and said plurality of support tubes being positionable inside said first or second box frame support member during shipping;

a splice disposed between a second end of said first box frame support member and a first end of said second box frame support member at a box frame support component juncture, said splice reinforcing and providing additional strength to said box frame support component juncture; and an end cap securely nestable inside a first end of said first box frame support member, said end cap preventing debris from entering said first end of said first box frame support member when said end cap is disposed relative to said first end of said first box frame support member.

2. The modular boat lift cover of claim 1, wherein said gable assembly is securely engageable with a canopy, said canopy being detachable from and reattachable to said modular boat lift cover, said canopy protecting said watercraft from sun and hurricane-level winds when said watercraft is at port.

3. The modular boat lift cover of claim 1, wherein said boat lift cover has a bowed configuration, at least a portion of a perimeter of said boat lift cover being reinforced by a modular rigid support frame.

4. The modular boat lift cover of claim 1, wherein said boat lift cover is usable for both lake type and tidal lifts.

5. The modular boat lift cover of claim 1, wherein said modular boat lift cover serves as a building block for expanding said modular boat lift cover to adapt to a second watercraft.

6. A modular boat lift cover for a first watercraft, said modular boat lift cover comprising:

a gable assembly including;

a plurality of peak fittings including two end peak fittings sandwiched about at least one internal peak fitting, said plurality of peak fittings being positioned on a peak of said gable assembly;

a plurality of bowed tubes being initially linear in shape but becoming bowed under stress, one of said plurality of bowed tubes being securely attachable to one of said plurality of peak fittings; and a plurality of box frame support members each supporting at least one of said plurality of bowed tubes, said plurality of bowed tubes being cooperatively engageable with at least one of said plurality of peak fittings, said plurality of peak fittings and said plurality of bowed tubes being positionable inside one of said plurality of box frame support members during shipping.

7. The modular boat lift cover of claim 6, wherein said gable assembly is securely engageable with a canopy, said canopy being detachable from and reattachable to said modular boat lift cover, said canopy protecting said watercraft from sun and hurricane-level winds when said watercraft is at port.

8. The modular boat lift cover of claim 6, wherein said boat lift cover is usable for both lake type and tidal lifts.

9. The modular boat lift cover of claim 6, wherein said modular boat lift cover serves as a building block for expanding said modular boat lift cover to adapt to a second watercraft.

* * * * *